United States Patent [19]

Theurer et al.

[11] Patent Number: 4,955,301

[45] Date of Patent: Sep. 11, 1990

[54] TIE EXCHANGE MACHINE

[75] Inventors: Josef Theurer, Vienna; Johann Hansmann, Klosterneuburg; Herbert Wörgötter, Linz, all of Austria

[73] Assignee: Franz Plasser Bahnbaumaschinen-Industriegesellschaft m.b.H., Vienna, Austria

[21] Appl. No.: 374,576

[22] Filed: Jun. 30, 1989

Related U.S. Application Data

[63] Continuation of Ser. No. 165,512, Mar. 8, 1988, abandoned.

[30] Foreign Application Priority Data

Jul. 23, 1987 [AT] Austria ..... 1873/87

[51] Int. Cl.[5] ..... E01B 29/10

[52] U.S. Cl. ..... 104/7.2; 104/9

[58] Field of Search ..... 104/2, 3, 6, 7.1, 7.2, 104/8, 9, 10, 12

[56] References Cited

U.S. PATENT DOCUMENTS 4,253,398 3/1981 Theurer et al. .
4,418,625 12/1983 Allmer .
4,534,295 8/1985 Theurer ..... 104/12 X
4,579,060 4/1986 Nameny et al. .
4,611,541 9/1986 Theurer ..... 104/2

FOREIGN PATENT DOCUMENTS 58177 1/1975 Australia ..... 104/9
91209 8/1978 Japan ..... 104/9
805075 11/1958 United Kingdom ..... 104/2

OTHER PUBLICATIONS

Railway Track & Structures (2/89), "And Now–Continuous–Action, Selective Tie Renewal", pp. 28–32.
"Railway Track Structures", Nov. 83, pp. 22–24.

*Primary Examiner*—Joseph F. Peters, Jr.
*Assistant Examiner*—Virna Lissi Mojica
*Attorney, Agent, or Firm*—Kurt Kelman

[57] ABSTRACT

A machine for exchanging old ties for new ties, which comprises a self-propelled standard railroad vehicle comprising a machine frame, undercarriages supporting the machine frame for mobility on the railroad track, a drive for advancing the vehicle in an operating direction, and an operator's cab. A tie exchanging device is connected to the machine frame and arranged within sight of the operator's cab, the tie exchanging device being operable for withdrawing the old ties and inserting the new ties and comprising a longitudinally adjustable tie gripping means including a tie clamp, a drive for longitudinally adjusting the tie gripping means, and respective drives for vertically adjusting and for operating the tie clamp between tie engaging and tie releasing positions. A drive is connected to the tie exchanging device for longitudinally displacing the device in the operating direction with respect to the machine frame, and a vertical tie conveyor is connected to the machine frame and arranged adjacent the tie exchanging device.

21 Claims, 3 Drawing Sheets

TIE EXCHANGE MACHINE

CROSS-REFERENCE TO RELATED APPLICATION

This is a continuation of our copending application Ser. No. 165,512, filed Mar. 8, 1988 now abandoned.

BACKGROUND OF THE INVENTION

1. Field of the Invention

The present invention relates to a machine for exchanging a group of at least old tie for of a group of at least one new tie in a railroad track consisting of two rails fastened to ties, which comprises a self-propelled standard railroad vehicle comprising a machine frame, undercarriages supporting the machine frame for mobility on the railroad track, and a drive for advancing the vehicle in an operating direction. A tie exchanging device is connected to the machine frame and is operable for withdrawing the old ties and inserting the new ties. This device comprises a longitudinally adjustable tie gripping means including a tie clamp, a drive for longitudinally adjusting the tie gripping means, and respective drives for vertically adjusting and for operating the tie clamp between tie engaging and tie releasing positions.

2. Description of the Prior Art

U.S. Pat. No. 4,253,398, dated Mar. 3, 1981, discloses a mobile apparatus for the continuous sequential replacement of all old ties of a track with a track renewal train which removes all the old ties and lays the new ties while the track rails are lifted and spread apart.

U.S. Pat. No. 4,611,541, dated Sept. 16, 1986, discloses a continuously advancing ballast cleaning machine with tie replacement devices, wherein the ballast is excavated, cleaned and returned while the track is raised a substantial amount. The tie pulling and inserting devices are mounted between the swivel trucks supporting the respective ends of the ballast cleaning machine frame and are connected to longitudinal displacement drives. These devices are used only when an obstacle hindering the operation of the ballast excavating chain is encountered on the shoulder of the track, i.e. they are merely auxiliary means in the ballast cleaning machine for occasional use. No control or control cab for operation of the auxiliary tie replacement devices is indicated.

It is also known, and has been widely practiced, to exchange only groups of ties in an existing track, for example every third or fourth tie or groups of adjacent ties between ties retained in the track to enable the same to support rolling stock traveling thereover, which is the technology to which the present invention relates. Such a partial tie exchange or renewal is repeated every few years until all the ties of the track has been replaced. Such a mechanized tie gang has been described on pages 22 to 24 of "Railway Track and Structures", November 1983. This mechanized tie gang comprises up to 24 pieces of equipment, such as tie cranes, spike pullers, tie shears, tie cranes for handling tie butts, rotary scarifiers, tie injectors, tampers, rail lifts, spikers and ballast regulators. In the operation of this tie gang, the old ties are withdrawn and placed on the shoulders of the track after optionally being sawn into chunks and they are then loaded onto railroad cars. The new ties are placed on the track shoulders for insertion. The loading and unloading of the ties may be effected at a different time than the tie exchange operation.

Commonly assigned U.S. applications Ser. Nos. 97,757, 97,759 and 97,760, all filed Sept. 17, 1987, disclose a mobile tie replacement apparatus which comprises at least one elongated bridge-like work vehicle having two undercarriages supporting respective opposite ends of the work vehicle on the railroad track, and a succession of different individual devices mounted on the work vehicle or vehicles between the undercarriages and operative to effectuate different sequential operations for exchanging the selected old ties for the new ties. The present invention provides specific improvements in such an apparatus.

Many tie exchange devices of different structures are known, which have a crane or cantilevered frame structure equipped with a tie clamping head. For example, U.S. Pat. No. 4,579,060, dated Apr. 1, 1986, discloses a tie exchanger with a compound clamping head. A pivotal crane is mounted on a forwardly projecting frame portion of a work vehicle, and an end of the crane carries a hydraulically operable tie gripping means with a tie clamp. The outrigger crane is relatively bulky compared to the frame of the work vehicle, which makes the structure unstable and, on the other hand, quite expensive. In addition, pulling or inserting a tie is relatively difficult since at least one of the undercarriages of the work vehicle rests with its full weight on the track in the immediate area of the tie exchange. The compound clamping head simultaneously grips a new tie and an old tie to enable the old tie to be withdrawn and the new tie to be inserted in two sequential stages. This makes the tie exchange even more difficult for the operator. More particularly, the uneven load exerted by the outrigger crane at one side of the vehicle makes an accurate, rapid and trouble-free tie exchange at least uncertain if not impossible. The device can be used only for the exchange of one tie at a time, and the old ties are usually placed on the track shoulder where the new ties also are stored ready for insertion. The productivity of such a tie exchange apparatus is quite limited. Moreover, such small work vehicles usually do not have their own drive and can be moved along the track only at low speeds.

Another type of tie exchanging apparatus is disclosed in U.S. Pat. No. 4,418,625, dated Dec. 6, 1983. This apparatus comprises a standard railroad vehicle comprising a horizontally extending machine frame and undercarriages supporting the machine frame for mobility on the railroad track. An extensible telescoping beam assembly carrying hydraulically actuated tie clamping arms on the opposite, remote ends is mounted on the machine frame between the undercarriages so that the tie gripping means are longitudinally adjustable and the tie clamps are also vertically adjustable. Alternatively, the tie exchanger may be mounted on a turret to permit controlled rotation about the vertical axis for operation on either side of the machine frame. No operator's seat or cab is provided on the frame within view of the tie gripping means so that the tie exchange operation may neither be observed or controlled from the vehicle. Presumably, an operator standing next to the track remote-controls the tie exchange. This apparatus, too, has a low productivity and only limited accuracy, particularly in view of the operating difficulties involved in the stop-and-go advance of the machine. The arrangement of the telescopingly extensible beam assembly carrying the tie gripping means under the horizontally extending machine frame provides very little space for the tie exchanging device.

SUMMARY OF THE INVENTION

It is the primary object of the present invention to improve a tie exchange machine of the first-described type for a partial replacement of ties in an existing railroad track so that the withdrawal of the old ties and the insertion of the new ties is simplified and dependable while a high productivity is assured.

The above and other objects are accomplished in accordance with this invention with such a machine by arranging the tie exchanging device within sight of an operator's cab on the machine frame, which is equipped with the required controls. A drive is connected to the tie exchanging device for longitudinally displacing the device in the operating direction with respect to the machine frame, and a vertical tie conveyor is connected to the machine frame and is arranged adjacent the tie exchanging device. The machine frame is bridge-like and preferably defines an upwardly recessed portion between the undercarriages, the tie exchanging device and vertical tie conveyor being arranged within the recessed frame portion. The tie exchanging device may be mounted on an auxiliary carrier frame.

This surprisingly simple, yet advantageous arrangement of the tie exchanging device associated with a vertical tie conveyor within sight of the operator on the machine frame and the longitudinal displaceability of the tie exchanging device provides a particularly rational tie exchange operation since the withdrawn old ties as well as the new ties to be inserted may be stored directly on the machine and carried along without the time-consuming placing of the ties on the track shoulder, the time required for moving the old ties thereto and receiving the new ties therefrom also being eliminated during the tie exchange operation. The longitudinal displaceability of the tie exchanging device on the bridge-like machine frame, which may be advanced continuously or intermittently during the tie exchange operation, in combination with the adjacent vertical tie conveyor adapted to remove the withdrawn old ties and to feed the new ties for insertion, greatly increases the efficiency of the tie exchange operation. The operator in the cab can readily control the longitudinal displacement of the tie exchanging device relative to the stationary or advancing machine frame so that the tie exchanging device will temporarily remain stationary while it withdraws or inserts a tie or groups of ties. This assures a simple, fast and trouble-free tie exchange.

The above and other objects, advantages and features of this invention will become more apparent from the following detailed description of certain now preferred embodiments thereof, taken in conjunction with the accompanying somewhat schematic drawing.

DESCRIPTION OF THE PREFERRED EMBODIMENT

Throughout the specification and claims, the term "standard railroad vehicle" designates a work vehicle which has the dimensions and capacity to enable it to run on a railroad track like any regular railroad car.

Figures 1, 2:
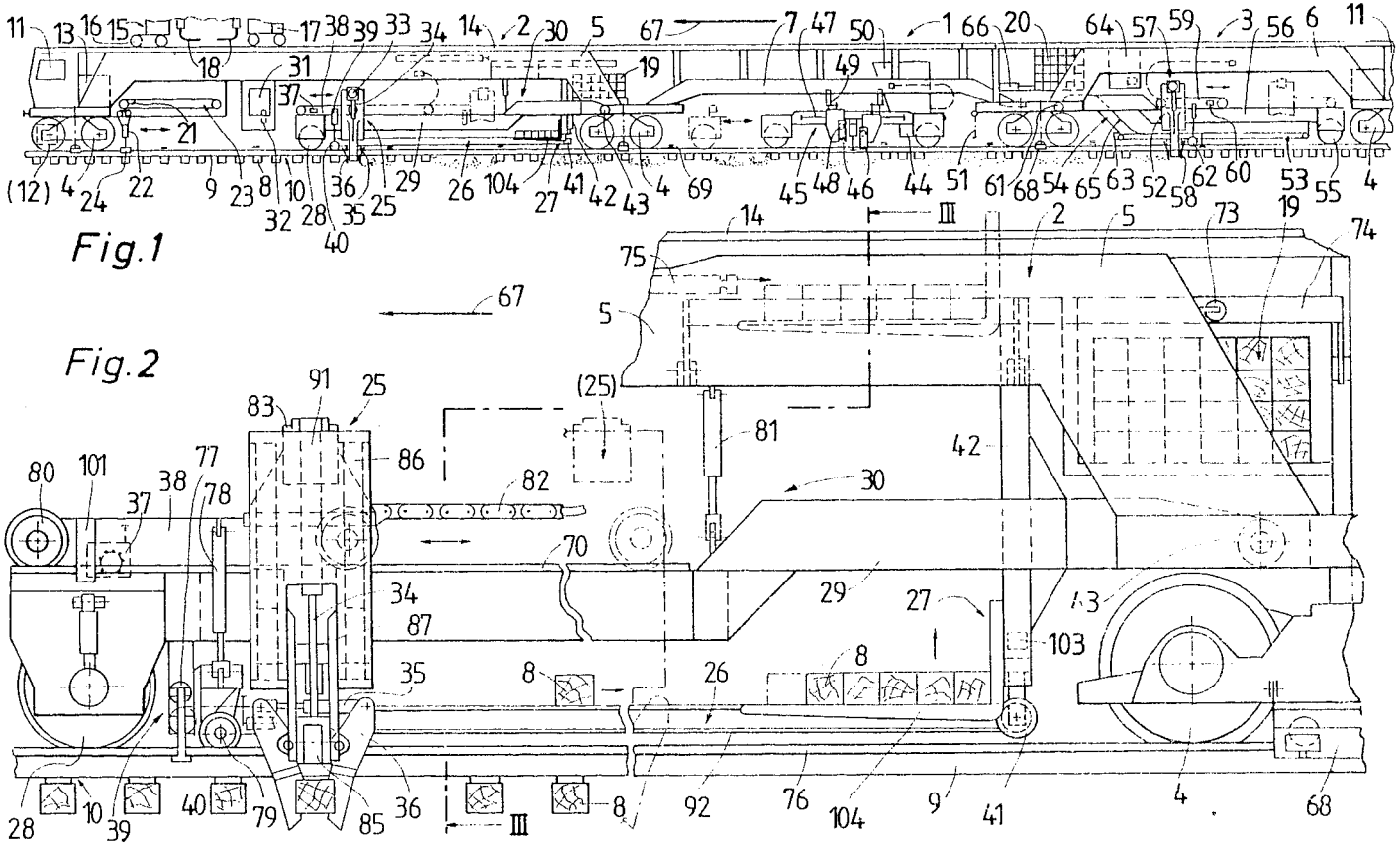
FIG. 1 is a side elevational view of a continuously advancing tie exchange train comprising two standard railroad vehicles carrying tie exchange devices and coupled together by a further standard railroad vehicle carrying a ballast clearing and planing device.
FIG. 2 is an enlarged side elevational view of a structural unit comprised of an auxiliary carrier frame with a tie pulling device, a vertical tie conveyor and a tie transporting device therebetween according to a preferred feature of the invention.

Referring now to the drawing and first to FIG. 1, there is shown train 1 for sequentially exchanging selected consecutive groups of old ties 8 fastened to rails 9 in existing railroad track 10 for groups of new ties while retaining groups of old ties therebetween to support the train on the track. The illustrated train comprises a first work vehicle 2 and a second work vehicle 3, coupled together by upwardly recessed machine frame 7. Each bridge-like work vehicle has a respective machine frame 5 and 6 defining an upwardly recessed portion between respective ends thereof.

Undercarriages constituted by swivel trucks 4 support the work vehicle frame ends on railroad track 10 and drive 12 is designed for the continuous advancement of the work vehicles in an operating direction indicated by arrow 67. Drive 12 receives its power from power plant 13 and respective driver's cabs 11 are mounted on machine frames 2 and 3 at the ends of train 1. A continuous guide track 14 for power-driven crane 15 is mounted atop upwardly recessed machine frames 5, 6 and 7. Double-flanged rollers 16 support the crane on the guide track, and the crane may be moved therealong by drive 17 on the crane. The crane is equipped with vertically adjustable gripper arms 18 rotatable about a vertical axis for gripping stacks 19 of ties on first work vehicle 2 and for placing a stack 20 of ties at the joining ends of machine frames 6 and 7.

Immediately adjacent driver's cab 11, tie plate transporting device 23 is mounted in the recessed portion of machine frame 5 of first vehicle 2. The tie plate transporting device has a magnet 24 for picking up tie plates previously detached from the ties and longitudinal displacement and lifting drives 21, 22 for raising and transporting the picked-up tie plates. Also mounted within this recessed machine frame portion is tie exchanging device 25 connected to the machine frame within view of operator's cab 31 housing operating control panel 32. Drive 37 is connected to the tie exchanging device, which serves to withdraw the old ties, for longitudinally displacing the device in the operating direction with respect to machine frame 5. Vertical tie conveyor 27 is connected to the machine frame and is arranged adjacent tie exchanging device 25. Tie transporting device 26 is arranged between the tie exchanging device and the vertical tie conveyor. This simple additional structure has the advantage of serving as a collecting station for the old and new ties during the tie exchange operation so that the old ties withdrawn from the railroad track may be temporarily stored on the tie transporting device during the tie withdrawal operation and need not be placed on the track shoulder while the new ties may be transported sequentially to the tie inserting device rather than being picked up from the track shoulder. This assures a substantially continuous tie exchange operation, which further enhances the productivity.

An auxiliary carrier frame 29 is mounted in the recessed frame portion of first bridge-like work vehicle 2, tie exchanging device 25, vertical tie conveyor 27 and tie transporting device 26 being mounted on auxiliary carrier frame 29 to form structural unit 30. One end of auxiliary carrier frame 29 is linked to the recessed frame portion of work vehicle 2 and an opposite end thereof is supported on the railroad track by undercarriage 28. Undercarriage 28 supports a forward end of auxiliary carrier frame 29 with flanged wheels on track rails 9 while the rear carrier frame end is linked to recessed frame 5 of work vehicle 2 by joint 43. Such a work vehicle may be incorporated into a tie exchange train which advances non-stop along the railroad track for partially exchanging groups of ties while retaining a tie or a group of ties between the exchanged groups of ties, or it may be used as an independent, self-propelled machine for the rapid exchange of relatively few groups of ties or even single ties.

Figure 4:
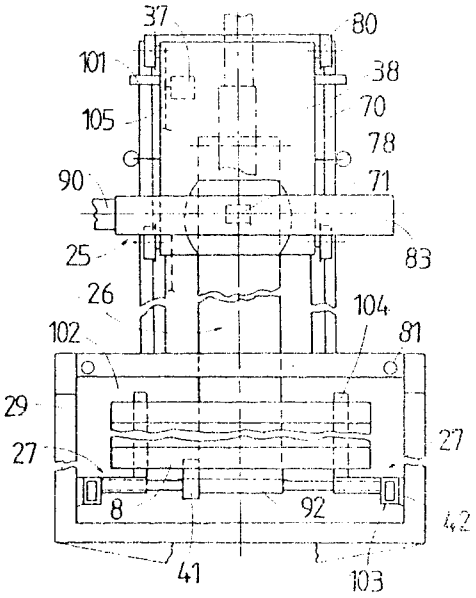
FIG. 4 is a smaller top view of the structural unit shown in FIGS. 2 and 3, FIGS. 5 and 6 are schematic side and top views, respectively, of another embodiment with a self-propelled standard railroad vehicle to which is connected an auxiliary carrier frame mounting a tie exchanging device.
Figure 3:
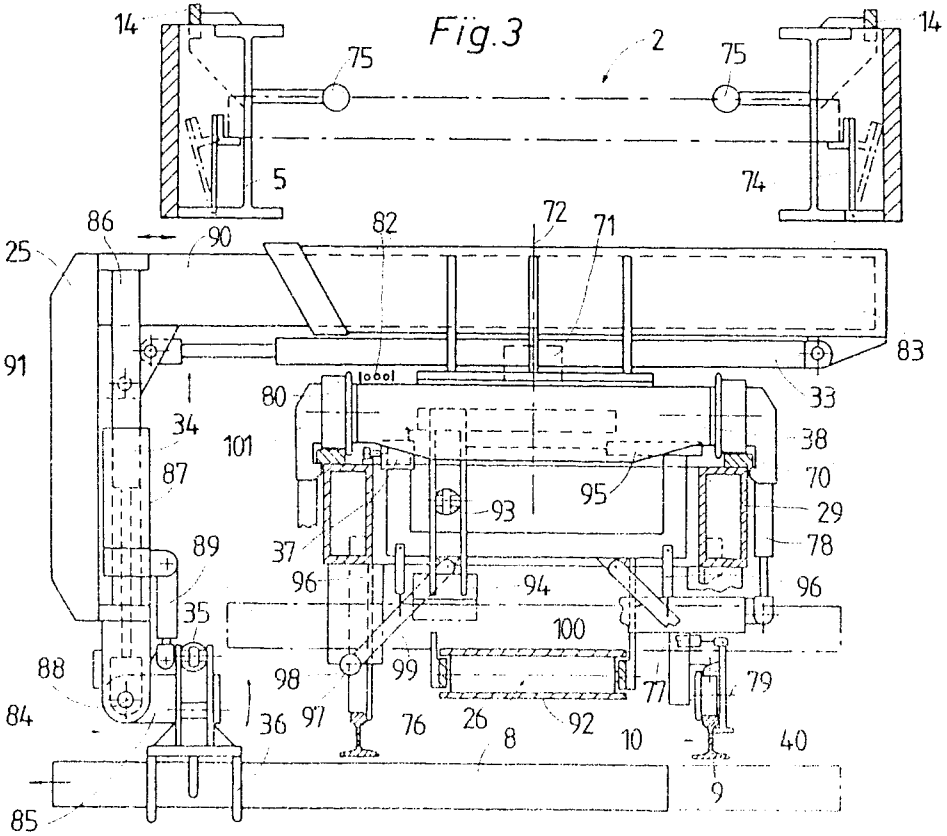
FIG. 3 is a section along line III—III of FIG. 2.

As shown in FIGS. 2 to 4, hydraulic lifting drive 81, which receives hydraulic fluid through flexible hose 82 from central power source 13, connects the auxiliary carrier frame to work vehicle frame 5 for vertically adjusting the auxiliary carrier frame. Vertical tie conveyor 27 and tie transporting device 26 consisting of endless conveyor band 92 are stationarily fixed to auxiliary carrier frame 29. Displacing drive 42 connects tie pulling device 25 to the auxiliary carrier frame for displacement relative thereto between a forward end position shown in full lines in FIG. 2 and a rear end position indicated in chain-dotted lines in this figure. Such a simple and compact structural unit enables the tie exchanging device to be automatically centered over the railroad track since the undercarriage guides the auxiliary carrier frame along the track even in sharp curves. In addition, this structure makes it possible to provide a tie transporting device of considerable length so that a relatively large number of ties may be collected on this device and stored on the machine.

Tie pulling device 25 comprises tie gripping means 84 including tie clamp 36, drive 35 for operating the tie clamp and drive 34 for vertically displacing the tie clamp. Carriage 38 supports tie gripping means 84 for rotation about vertical axis 72 by drive 71 for rotating the carriage. The carriage is longitudinally displaceable along guide track 70 on auxiliary carrier frame 29 in the operating direction. Tie clamp 36 with its operating drive 35 is mounted on support body 85 which, in turn, is mounted on support body 87 vertically adjustably guided on a pair of vertical guides 86. Drive 34 is connected to support body 87 for vertical adjustment of the tie gripping means. Support body 85 is pivotally mounted on support body 87 for pivoting about transverse axis 88 by pivoting drive 89. Vertical guides 86 are affixed to support 91 connected to carrier beam 90. The carrier beam is telescopingly received in guide element 83 extending transversely to auxiliary carrier frame 29 so that tie gripping means 84 may be displaced in the transversely extending guide element by drive 33 respectively linked to guide element 83 and to vertical guide 86. Since the operating motions of the various operating devices extend rectilinearly in a horizontal or vertical direction, the operation proceeds substantially automatically in a highly accurate and efficient manner. Mounting the tie exchanging device longitudinally displaceably on a carriage enables it to pull or insert a group of adjacent ties in rapidly proceeding operating motions of the tie gripping means controlled by an operator within sight of the device so that the entire operation will be very accurate and fast. The rotation of the tie exchange device about a vertical axis makes it possible to use it at either side of the railroad track.

Tie transporting device 26 comprises endless tie collecting conveyor band 92 extending below and parallel to auxiliary carrier frame 29 in the operating direction. Drive 41 operates the conveyor band. Vertically adjustable clamping means 94 consisting of a pair of gripping tongs operated by drive 93 is arranged to grip ties collected on endless conveyor band 92 and is transversely displaceably mounted on carriage 38, displacement drive 95 connecting the clamping means to the carriage. This arrangement has the advantage that the withdrawn old ties may be temporarily collected and stored, and the new ties to be inserted may be delivered over the entire displacement path of the tie exchanging device.

Vertical tie conveyor 27 comprises two vertically adjustable fork lift elements 104 arranged to support opposite ends of ties 8 collected on endless conveyor band 92, the fork lift elements extending through opening 102 in the one end of auxiliary carrier frame 29 linked to work vehicle frame 5 and the opening having a width corresponding to at least one tie length. Drive 103 vertically adjusts the fork lift elements between a lower position (shown in full lines in FIG. 2) and an upper position (shown in chain-dotted lines in this figure). Two L-shaped tie retaining ledges 74 are mounted on the work vehicle frame for pivoting about an axis extending in the operating direction, the tie retaining ledges extending in that direction and being spaced a distance substantially corresponding to a tie length. Drive means 73 is arranged to pivot the ledges between a tie retaining position and a tie releasing position respectively shown in FIG. 3 in full and chain-dotted lines. This arrangement of the vertical tie conveyor combined with the two pivotal retaining ledges enables the transfer of layers of ties to form a stack of ties to be effected simply and effectively. Pivoting of the retaining ledges makes it possible to raise the layers of ties to the level of the retaining ledges and then to retain the raised layer of ties.

Auxiliary carrier frame 29 is held on the railroad track by device 39 comprising hold-down clamping means 40 adjacent undercarriage 28, which is arranged for clampingly engaging at least one rail head 76 of the railroad track and is operated by drive 77. The railhead clamping means is connected to carriage 38 of tie pulling device 25 by vertical adjustment drive 78. Holding device 39 is guided along the railroad track rails by flanged wheels 79 cooperating with the clamping means. This arrangement assures a proper force transmission directly adjacent the tie pulling and inserting device whereby torsion of the auxiliary frame is dependably avoided, regardless of the momentary position of the device on the auxiliary carrier frame.

Vertically adjustable support rollers 97 are arranged at both sides of endless tie collecting conveyor band 92 and the support rollers are rotatable about axes 98 extending in the operating direction. Support arms 99 link the support rollers to an underside of the carriage and drive means 96 link the support arms to the underside of carriage 38 for pivoting the support arms for vertically adjusting the support rollers. This simple arrangement of support rollers provides a secure support for the ties while they are loaded. Also, since the conveyor band is not subjected to the direct impact of the ties falling onto the conveyor band but the support rollers gently place the ties thereon, the operating life of the conveyor band is increased and a trouble-free operation is assured.

Holding brackets 100 connect conveyor band 92 to auxiliary carrier frame 29. To prevent carriage 38 from tilting, it has fork-shaped holding elements 101 undercutting the rails of guide track 70 on auxiliary carrier frame 29. As shown in FIG. 4, longitudinal displacement drive 37 mounted on carriage 38 has a pinion meshing with chain 105 mounted on auxiliary carrier frame 29.

As shown in FIG. 1, another auxiliary carrier frame 56 is mounted in the recessed frame portion of second bridge-like work vehicle 3, tie exchanging device 52 serving to insert the new ties, the associated vertical tie conveyor 54 and tie transporting device 63 being mounted on the other auxiliary carrier frame to form structural unit 57. Except for vertical tie conveyor, structural unit 57 has the same structure as unit 30 described hereinabove in connection with FIGS. 2 to 4. The vertical tie conveyor is constituted by chute 65 leading from stack 20 of new ties to the tie transporting device and a hydraulically operated drive 66 pushes the lowest layer of ties from the stack in the direction of structural unit 57 so that a sequence of new ties is delivered to the chute and subsequent tie transporting device 53. Another operator's cab 64 with a control panel is mounted in the recessed frame portion of the second work vehicle. In the same manner as described hereinabove in connection with work vehicle 2, tie inserting device 52 is supported on wheeled carriage 59 slidably mounted on auxiliary frame 56 and connected to longitudinal displacement drive 60 for longitudinally displacing the tie inserting device. The rearmost end position of the tie inserting device with respect to auxiliary carrier frame 56 is shown in chain-dotted lines. Undercarriage 55 supports a rear end of auxiliary carrier frame 56 with flanged wheels on the track rails while the forward carrier frame end is linked to recessed frame 6 of work vehicle 3 by joint 61. Vertically adjustable holding clamp 62 is connected to the wheeled carriage and slidably grips the head of rail 9. The tie transporting device extends below auxiliary carrier frame 56 and therealong, this device being illustrated as an endless conveyor band mounted on the auxiliary carrier frame and driven by drive 63. Vertical tie conveyor 54 precedes tie inserting device 52 and is connected at the front end of auxiliary carrier frame 56 to machine frame 6. The arrangement of vertical tie conveyor 54 rearwardly of tie puller 25 and of vertical tie conveyor 27 in front of tie inserter 52 has the considerable advantage that the old ties may be stored on train 1 and the new ties may be supplied to the tie inserter directly from the train without the need of depositing the ties on the track shoulders.

To make certain that two-axled swivel trucks 4 securely follow the rails, they are equipped with a gage maintaining guide means 68 which forceably holds the truck wheels in engagement with the rails.

The tie pulling operation proceeds in the following manner:

Old ties 8 are gripped by tie gripping means 84 (FIG. 3). For this purpose, drive 35 is actuated to move the two tongs of tie clamp 36 together to engage the tie. Drive 33 is then actuated to displace carrier beam 90, support 91 with gripping means 84 and tie 8 transversely. As soon as the tie has been fully withdrawn laterally from railroad track 10, drives 34 and 89 are actuated for vertical adjustment and pivoting of tie 8 about axis 88. In this position, the withdrawn old tie is deposited on support roller 97 and is displaced by drive 33 so far in the direction of endless conveyor band 92 that the tie rests on the support roller and conveyor band when tie clamp 36 is disengaged therefrom. Drive 96 is then actuated to pivot support arms 99 upwardly so that the raised tie may be gripped by tie gripping tongs 94. Actuation of drive 93 causes the tie gripping tongs to engage the tie and drive 95 is then actuated to move the tie gripping tongs with the gripped tie to the right, as seen in FIG. 3, until tie 8 is centered with respect to tie collecting conveyor band 92 (chain-dotted lines). Afterwards, the tie gripping tongs are disengaged from the tie and are raised. Actuation of drive 41 operates the conveyor band to convey the tie to fork lift elements 104 of vertical tie conveyor 27. Meanwhile, a subsequent tie is withdrawn by tie pulling device 25 in the above-described manner. After a layer of six old ties of a tie stack 19 has been deposited on fork lift elements 104, drive 103 is actuated to convey this layer of old ties to retaining ledges 74. As shown in chain-dotted lines in FIG. 3, these retaining ledges have been pivoted out of the way of the upwardly moving ties until they have reached the upper end position, at which time the L-shaped retaining ledges are pivoted into the position indicated in full lines so that the ends of the ties are supported thereon. While the fork lift elements are lowered again, drive 75 is actuated to displace the layer of ties along retaining ledges 74 until they come to rest on stack 19. At this time, the retaining ledges are again pivoted out of engagement with the tie ends so that the ties fall on top of stack 19. Tie pulling device 25, which is longitudinally displaced intermittently for each tie pulling operation by drive 37, is firmly held on rail head 76 by hold-down clamp 40 during each tie pulling operation. This prevents a tilting of the device and auxiliary carrier frame 29 supported on the railroad track by undercarriage 28. Actuation of rotating drive 71 enables tie pulling device 25 to be turned 180° so that old ties may be pulled out of the track from the opposite side. When train 1 moves between operating sites, tie pulling device 25 is so pivoted by drive 71 that guide 83 extends in the direction of the track and tie gripping means 84 is close to undercarriage 28 (chain-dotted lines in FIG. 4).

As shown in FIG. 1, the two successive standard railroad vehicles 2 and 3 form train 1 advancing continuously along the railroad track during the tie exchange operation, the two vehicles being coupled together by upwardly recessed machine frame 7 whose ends are pivotally mounted on the leading and trailing vehicles above swivel trucks 4. Ballast clearing and planing device 45 is mounted on machine frame 7 within its recessed frame portion and this ballast scarifier is equipped with its own drive 44 and is capable of clearing the ballast and planing it for providing a proper support for the new ties and the cribs therebetween. A useful ballast clearing and planing device has been described and claimed patent application Ser. No.

07/165,509, simultaneously filed by Josef Theurer and Herbert Worgotter, entitled "Mobile Tie Gang Apparatus and Tie Exchange Method". Device 45 has a frame supported on flanged wheels running on railroad track 10 and has a pair of ballast clearing elements 46 for each rail 9, drives 47, 48 and 49 being arranged for adjusting the ballast clearing elements longitudinally in the operating direction as well as transversely and vertically thereto. Operator's cab 50 is mounted on the frame of device 45 to enable an operator to control the ballast scarifier and drive 44 preferably receives its power from central power plant 13, being connected thereto by flexible lines. Coupling rod 51 enables ballast clearing and planing device 45 to be connected to machine frame 7 when train 1 moves between operating sites.

As shown, storage places for a stack 19 of old ties and a stack 20 of new ties are provided at ends of the recessed frame portions of frames 5 and 6 supported by respective undercarriages 4, the storage places respectively succeeding vertical conveyor 27 for the old ties and preceding vertical conveyor 54 for the new ties. Respective drive 66 and 75 removes the ties from stack 20 and feeds them to stack 19. This arrangement assures a trouble-free continuous work flow so that the tie exchange operation may proceed continuously over an extended period of time.

Figure 5:
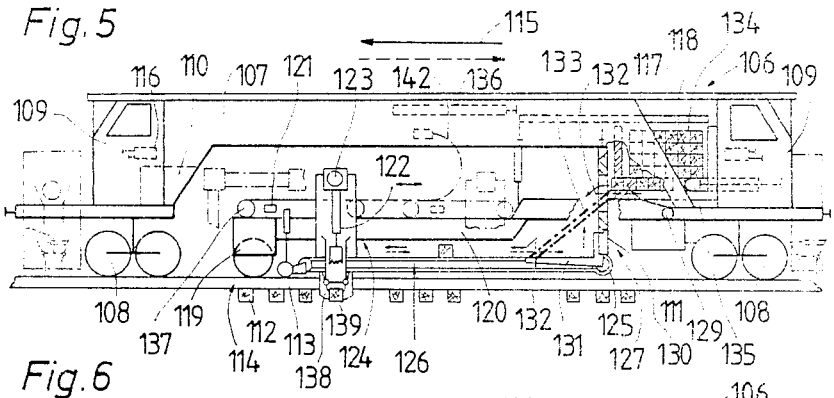
Figure 6:
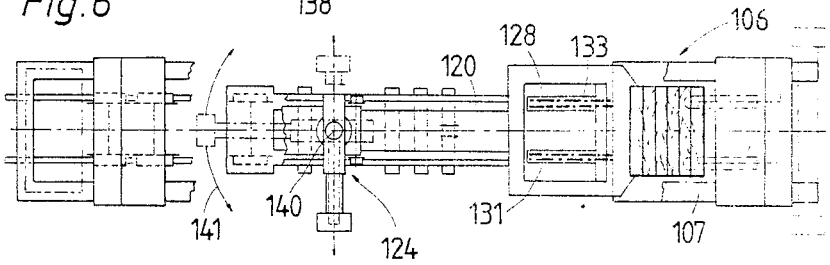

FIGS. 5 and 6 illustrate an embodiment of self-propelled standard railroad work vehicle 106 comprising upwardly recessed machine frame 107 and respective operator's cabs 109 mounted at the ends of the machine frame above two-axled swivel trucks 108 supporting the machine frame on track 114 consisting of rails 113 fastened to ties 112 for mobility in an operating direction indicated by arrow 115. The vehicle has its own drive 111 and central power plant 110. Each operator's cab has a control panel 116 for controlling the drive and operation of the machine. Guide track 117 is mounted atop machine frame 107 and is capable of supporting a power-driven crane for movement therealong so that work vehicle 106 may be, if desired, coupled to a continuously advancing work train in the manner of the afore-mentioned copending patent applications and the crane may be moved along the guide track to and from the storage place 118 for stack 134 of ties.

Auxiliary carrier frame 120 mounting tie exchanging device 124 has one end linked to the recessed portion of frame 107 at joint 129 and an opposite end thereof supported on railroad track 114 by undercarriage 119. Longitudinal displacement drive 121 is connected to the tie exchanging device which is vertically and transversely adjustable by drives 122 and 123. A tie transporting device consisting of endless conveyor band 126 and drive 125 for reversibly moving the conveyor band is arranged on auxiliary carrier frame 120 between tie exchanging device 124 and vertical tie conveyor 127 at the one auxiliary carrier frame end for selectively removing old ties 112 from the tie exchanging device and feeding new ties thereto. As in the previously described embodiment, the vertical tie conveyor comprises two fork lift elements 131 mounted for vertical movement by drive 130 through opening 128 in this auxiliary carrier frame end. Rod-shaped intermediate members 133 are associated with the fork lift elements and may be coupled by quick-release fastening elements 132 to the respective outer ends of the fork lift elements to bridge thereover in the manner clearly shown in FIG. 5. The upper ends of the intermediate rod members lead through opening 128 and passages in machine frame 107 to the level of the lowest layer of tie stack 134 at storage place 118 which trails vertical tie conveyor 127 in the operating direction. Ties 112 are removed from, and fed to, the stack by preferably hydraulically operable drives 135 and 136, respectively. In this way, the vertical tie conveyor may be rapidly converted from conveying old ties to conveying new ties.

Such a relatively simply constructed work vehicle may be used for a variety of tie exchange operations. It may be used, for example, merely to pull each second or third tie or sequentially spaced groups of adjacent ties as the vehicle is advanced over a short or longer track section. With little adjustment, the vehicle could also be used only for inserting new ties along such a track section. One tie or a group of adjacent ties may be pulled or inserted while the vehicle stands still or while it continuously advances since the longitudinal displaceability of the tie exchanging device affords sufficient time for the tie pulling or inserting operation during the continuous advance of the vehicle. Finally, the vehicle may be incorporated into a continuously advancing tie exchange train, such as shown in FIG. 1. In other words, this work vehicle is universally adaptable. When used independently, additional machines must be used, of course, to prepare the old ties for pulling, such as pulling the spikes and removing the tie plates, and for fastening the new ties to the rails after they have been inserted. Thus, the work vehicle may be advantageously used in any mechanized tie gang and will enhance the efficiency of the tie pulling and inserting operations. Providing the rapidly detachable rod-shaped intermediate member bridging the fork lift elements of the vertical tie conveyor enables the work vehicle to be readily converted to the desired use. Storage space 118 can be used for storing the old as well as the new ties.

Auxiliary carrier frame 120 mounting tie exchanging device 124 on carriage 137 as well as the tie transporting device and vertical tie conveyor are of substantially the same structure as the above-described structural units, except for intermediate member 133 and drive 135 for feeding new ties. All the drives for operating the tie exchanging devices remove their power from central power plant 110 through lines 142, hydraulic operation being preferred. As shown in chain-dotted lines, a tie puller may be mounted on a projecting forward end of machine frame 107 and a tie tamper combined with a tie positioning device may be mounted on a projecting rear machine frame end.

Figure 7:
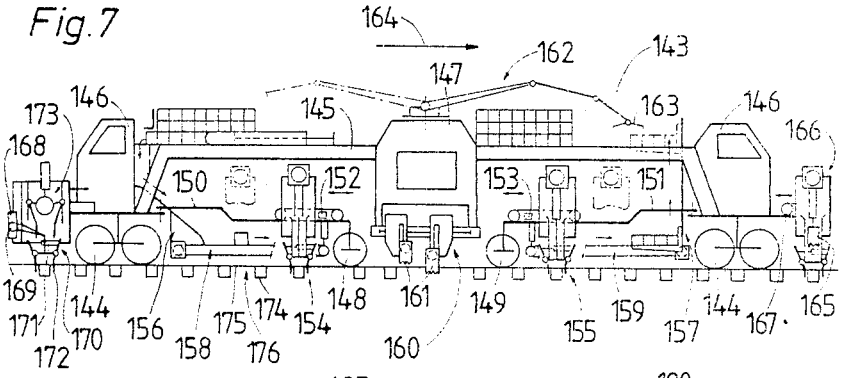
FIG. 7 is a schematic side view of a third embodiment wherein two auxiliary carrier frames respectively mounting a tie pulling and a tie inserting device are arranged in a recessed portion of a machine frame of a self-propelled standard railroad vehicle.

FIG. 7 schematically illustrates an embodiment of a self-propelled standard railroad work vehicle 143 whose bridge-like machine frame 145 defines an upwardly recessed portion between undercarriages 114 constituted by two-axled swivel trucks 144 supported on railroad track 176 consisting of rails 175 fastened to ties 174. The machine frame has front and rear portions with respect to the operating direction of the vehicle indicated by arrow 164, the front and rear portions projecting beyond the swivel trucks. A driver's cab 146 is mounted at each end of the machine frame above the swivel trucks. Two auxiliary carrier frames 150, 151 are arranged in the recessed frame portion between the swivel trucks, each auxiliary carrier frame mounting a respective tie exchanging device 154, 155, a respective vertical tie conveyor 156, 157 and a respective tie transporting device 158, 159 comprising an endless conveyor band arranged on each auxiliary carrier frame between the respective tie exchanging device and vertical tie conveyor. One end of the auxiliary carrier frames is linked to the recessed frame portion and opposite ends thereof are supported on the railroad track by respective undercarriages 148, 149. These undercarriages leave a free space therebetween in the center of the recessed frame portion and operator's cab 147 is arranged above the free space. Ballast clearing and planing device 160 is arranged in the free space below cab 147, tie puller 166 is arranged on the front machine frame portion and tie tamping device 173 with tie positioning device 170 is arranged on the rear machine frame portion. The ballast clearing and planing device is equipped with longitudinally, transversely and vertically adjustable ballast clearing elements 161. Pivotal crane 162 is arranged above operator's cab 147 and comprises tie gripping means 163. Tie puller 166 is combined with vertically adjustable ballast clearing device or scarifier 165 and is preferably connected to drive 167 for longitudinally displacing the tie puller with respect to machine frame 145. The tie puller is used to withdraw the old ties by a distance corresponding to about one third of their length before they are fully withdrawn by tie exchanging device 155, operation of ballast scarifier 165 facilitating the partial tie withdrawal by clearing away ballast from the track shoulder adjacent the tie ends. Ballast clearing and planing device 160 clears and planes the ballast bed portion in the free space to prepare the same for supporting the new ties to be inserted by device 154. The new ties are fed to tie exchanging device 154 by vertical tie conveyor 156 and tie transporting device 158 and are inserted into the railroad track a distance corresponding to about two thirds of the tie length. The tie positioning device comprises vertical adjustment drive 168 and transverse adjustment drive 169 for positioning the device, and tie clamp 172 operated by drive 171 for gripping a tie to be positioned for tamping. The tie positioning device fully inserts the new ties between rails 175 and properly positions them, whereupon the ties are tamped.

This self-propelled work vehicle can be used for pulling old ties and replacing them with new ties in a single operating stage. The arrangement of the tie puller and ballast scarifier leading tie pulling device 155 and the tie positioning and tamping devices trailing tie inserting device 154 enhances not only the productivity of the machine but also improves the quality of the tie exchange operation. The tie exchange proceeds so rapidly with this work vehicle that a relatively long track section may be worked in a relatively short time, thus reducing the down-time of the track between passenger or freight trains and greatly increasing the economy of the tie exchange operation. This machine may be used while it advances continuously or intermittently between tie exchange operations, the rapid movability of the tie exchanging devices on their auxiliary carrier frames enabling the operator or operators in cab 147 to control the operation effectively.

Figure 8:
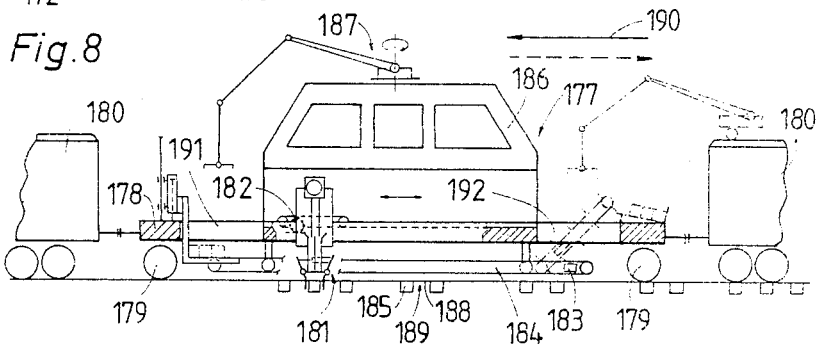
FIG. 8 is a like side view of yet another embodiment wherein a horizontally extending machine frame of a standard railroad vehicle carries a single longitudinally displaceable tie exchanging device.

FIG. 8 illustrates a relatively simple embodiment of standard railroad work vehicle 177 wherein machine frame 178 extends substantially horizontally, i.e. a flatbed car. The frame is supported on two undercarriages 179 running on railroad track 189 consisting of rails 188 fastened to ties 185 and the car may be coupled to a train of several tie transport open-top freight cars 180 moving in an operating direction indicated by arrow 190. Tie exchanging device 181 is longitudinally displaceably mounted on horizontally extending machine frame 178 for respectively pulling old ties and inserting new ties, drive 182 being connected to the tie exchanging device for longitudinal displacement thereof. Reversibly driven endless tie transporting conveyor band 184 is arranged below the flat machine frame and is actuated by drive 183 for selectively removing and feeding old and new ties from and to tie exchanging device 181. The machine frame defines openings 191, 192 at the ends thereof adjacent respective undercarriages 179, which openings have a width corresponding to at least one tie length for respectively removing the old ties from the conveyor band and feeding the new ties thereto. Operator's cab 186 is mounted on machine frame 178 centrally between openings 191 and supports pivotal crane 187 for hoistening ties.

Such a tie exchange machine is particularly simple and may be readily incorporated into a continuously advancing work train with transport cars for the old and new ties. On the other hand, the machine may be equipped with its own drive for independent use or it may be coupled to other work vehicles carrying various preparatory tools used in tie exchange operations. While the machine stands still, a group of adjacent ties may be pulled or inserted by the longitudinally displaceable tie exchange device and the machine is then moved to the next group of ties, which increases the productivity of the tie exchange. The structure of the machine is exceedingly simple, the operating devices are within view of the operator and the control is very easy.

At the forward end of conveyor band 184, as seen in the direction of arrow 190, a fork lift is affixed to machine frame 178 and extends into opening 191 for receiving the ties transported by the conveyor band. While the same arrangement may be provided at the rear end in opening 192, another tie transport device has been indicated there in chain-dotted lines, consisting of an obliquely rising endless conveyor band for conveying the ties from a rear end of conveyor band 184 to a suitable storage place. At the left of FIG. 8, a power-driven mobile crane is shown in chain-dotted lines. This crane is movable on a guide track atop open-top freight cars 180 for transporting the ties to and from vehicle 177 during the tie exchange operation.

Depending on individual operating conditions encountered in tie exchange operations, the machines illustrated in FIGS. 5 to 8 may be readily adapted to such conditions at a minimum of effort and cost. For example, the vertical tie conveyor shown in opening 192 of vehicle 177 in FIG. 8 may lead directly to an outlet of adjacent tie transport car 180. On the other hand, such a car may serve for transporting assorted tools needed in preparation for pulling old ties and for fixing new ties in position, for example a spike pulling device, tie plate removing device, ballast scarifier and spike drive. It is also possible, of course, to replace structural units 30 and 57 of the embodiment of FIG. 1 with the structural unit shown in FIGS. 5 and 6. Such a self-propelled installation with operator's cabs 11 at the ends thereof, as shown in FIG. 1, would have the structural unit installed on vehicle 2 without tie transfer member 133 while vehicle 3 would carry the unit with the tie transfer member.

What is claimed is:

1. A machine for exchanging a group of at least one old tie for a group of at least one new tie in a railroad track consisting of two rails fastened to ties, which comprises (a) a self-propelled standard railroad vehicle comprising
(1) a bridge-like machine frame,
(2) undercarriages supporting the machine frame for mobility on the railroad track, the machine frame defining an upwardly recessed portion between the undercarriages,
(3) a drive for advancing the vehicle in an operating direction, and
(4) an operator's cab,
(b) a tie exchanging device connected to the machine frame and arranged within sight of the operator's cab, the tie exchanging device being operable for withdrawing the old ties and inserting the new ties and comprising
(1) a longitudinally adjustable tie gripping means including a tie clamp for gripping an end of the ties laterally projecting from the track,
(2) a drive for longitudinally adjusting the tie gripping means for respectively moving the old ties laterally out of, and inserting the new ties laterally into, the track, and
(3) respective drives for vertically adjusting and for operating the tie clamp between tie engaging and tie releasing positions.
(c) a drive connected to the tie exchanging device for longitudinally displacing the device in the operating direction with respect to the machine frame,
(d) vertical tie conveyor connected to the machine frame and arranged adjacent the tie exchanging device,
(1) the tie exchanging device and vertical tie conveyor being arranged within the recessed frame portion; and
(e) a tie transporting device arranged between the tie exchanging device and the vertical tie conveyor,
(1) the vertical tie conveyor and the tie transporting device being arranged to receive, convey and transport the ties positioned transversely to the track.

2. The machine of claim 1, wherein a storage place for a stack of the ties is provided at an end of the recessed frame portion supported by a respective one of the undercarriages, the storage place succeeding the vertical tie conveyor in the operating direction, and further comprising a respective power drive for removing ties from the stack and feeding ties to the stack.

3. The machine of claim 1, further comprising an auxiliary carrier frame mounting the tie exchanging device.

4. A machine for exchanging a group of at least one old tie for a group of at least one new tie in a railroad track consisting of two rails fastened to ties, which comprises
(a) a self-propelled standard railroad vehicle comprising
(1) a bridge-like machine frame having front and rear portions with respect to the operating direction,
(2) undercarriages supporting the machine frame mobility on the railroad track, the machine frame defining an upwardly recessed portion between the undercarriages, the front and rear machine frame portions projecting beyond the undercarriages,
(3) a drive for advancing the vehicle in an operating direction, and
(4) an operator's cab,
(b) a tie exchanging device connected to the machine frame and arranged within sight of the operator's cab, the tie exchanging device being operable for withdrawing the old ties and inserting the new ties and comprising
(1) a longitudinally adjustable tie gripping means including a tie clamp for gripping an end of the ties laterally projecting from the track,
(2) a drive for longitudinally adjusting the tie gripping means for respectively moving the old ties laterally out of, and inserting the new ties laterally into, the track and
(3) respective drives for vertically adjusting and for operating the tie clamp between tie engaging and tie releasing positions,
(c) a drive connected to the tie exchanging device for longitudinally displacing the device in the operating direction with respect to the machine frame,
(d) a vertical tie conveyor connected to the machine frame and arranged adjacent the tie exchanging device,
(1) the tie exchanging device and vertical tie conveyor being arranged within the recessed frame portion,
(e) two auxiliary carrier frames each mounting a respective tie exchanging device and a respective tie conveyor,
(f) a tie transporting device comprising an endless conveyor band arranged on each auxiliary carrier frame between the respective tie exchanging device and vertical tie conveyor,
(1) one of the auxiliary carrier frame ends being linked to the recessed frame portion and opposite ends thereof being supported on the railroad track by respective undercarriages,
(2) the undercarriages leaving a free space therebetween in the center of the recessed frame portion, and
(3) the operator's cab being arranged above the free space,
(g) a ballast clearing and planing device arranged in the free space below the operator's cab,
(h) a tie puller arranged on the front machine frame portion, and
(i) a tie tamping device combined with a tie positioning device arranged on the rear machine frame portion.

5. The machine of claim 4, further comprising a ballast clearing device combined with the tie puller.

6. The machine of claim 4, further comprising a pivotal crane arranged above the operator's cab, the crane comprising tie gripping means.

7. A machine for exchanging a group of at least one old tie for a group of at least one new tie in a railroad track consisting of two rails fastened to ties, which comprises
(a) a self-propelled standard railroad vehicle comprising
(1) a bridge-like machine frame,
(2) undercarriages supporting the machine frame for mobility on the railroad track, the machine frame defining an upwardly recessed portion between the undercarriages,
(3) a drive for advancing the vehicle in an operating direction, and
(4) an operator's cab,
(b) a tie exchanging device connected to the machine frame and arranged within sight of the operator's cab, the tie exchanging device being operable for withdrawing the old ties and inserting the new ties and comprising (1) a longitudinally adjustable tie gripping means including a tie clamp for gripping an end of the ties laterally projecting from the track, (2) a drive for longitudinally adjusting the tie gripping means for respectively moving the old ties laterally out of, and inserting the new ties laterally into, the track, and (3) respective drives for vertically adjusting and for operating the tie clamp between tie engaging and tie releasing positions, (c) a drive connected to the tie exchanging device for longitudinally displacing the device in the operating direction with respect to the machine frame, (d) a vertical tie conveyor connected to the machine frame and arranged adjacent the tie exchanging device, (1) the tie exchanging device and vertical tie conveyor being arranged within the recessed frame portion, (e) an auxiliary carrier frame mounting the tie exchange device, and (f) a tie transporting device arranged on the auxiliary carrier frame between the tie exchange device and the vertical tie conveyor.

8. The machine of claim 7, wherein one of the auxiliary carrier frame ends is linked to the recessed frame portion and an opposite end thereof is supported on the railroad track by an undercarriage, the tie transporting device consists of an endless conveyor band and a drive for reversibly moving the endless conveyor band, and further comprising an intermediate member associated with the vertical tie conveyor at the one auxiliary carrier frame end and arranged to enable the vertical tie conveyor to operate selectively for removing the old ties and feeding the new ties.

9. The machine of claim 7, wherein the auxiliary carrier frame with the tie exchanging device, the vertical tie conveyor and the tie transporting device forms a structural unit, one of the auxiliary carrier frame ends being linked to the recessed frame portion and an opposite end thereof being supported on the railroad track by an undercarriage, and further comprising a lifting drive for vertically adjusting the auxiliary carrier frame, the vertical tie conveyor and the tie transporting device consisting of an endless conveyor band and a drive for the endless conveyor band being stationarily fixed to the auxiliary carrier frame, and the longitudinal displacement drive connecting the tie exchanging device to the auxiliary carrier frame for displacement relative thereto.

10. The machine of claim 9, comprising two successive ones of said standard railroad vehicles, the auxiliary carrier frame connected to the recessed frame portion of a first one of said vehicles mounting a tie exchanging device serving to withdraw the old ties and the auxiliary carrier frame connected to the recessed frame portion of a second one of said vehicles mounting a tie exchanging device serving to insert the new ties, the railroad vehicles forming a train advancing continuously along the railroad track during the tie exchanging operations.

11. The machine of claim 10, wherein the train further comprises a recessed machine frame coupled to the first and second vehicles therebetween, and further comprising a ballast clearing and planing device mounted on the machine frame.

12. The machine of claim 11, wherein a rear undercarriage of the first vehicle and a front undercarriage of the second vehicle are swivel trucks, the recessed machine frame has respective ends pivotally mounted on the swivel trucks, and respective storage places for stacks of the old and new ties are provided at said ends adjacent a respective one of the vertical conveyors for respectively vertically conveying the old end the new ties.

13. A machine for exchanging a group of at least one old tie for a group of at least one new tie in a railroad track consisting of two rails fastened to ties, which comprises (a) a self-propelled standard railroad vehicle comprising (1) a bridge-like machine frame, (2) undercarriages supporting the machine frame for mobility on the railroad track, the machine frame defining an upwardly recessed portion between the undercarriages, (3) a drive for advancing the vehicle in an operating direction, and (4) an operator's cab, (b) a tie exchanging device connected to the machine frame and arranged within sight of the operator's cab, the tie exchanging device being operable for withdrawing the old ties and inserting the new ties and comprising (1) a longitudinally adjustable tie gripping means including a tie clamp for gripping an end of the ties laterally projecting from the track, (2) a drive for longitudinally adjusting the tie gripping means for respectively moving the old ties laterally out of, and inserting the new ties laterally into, the track, and (3) respective drives for vertically adjusting and for operating the tie clamp between tie engaging and tie releasing positions, (c) a drive connected to the tie exchanging device for longitudinally displacing the device in the operating direction with respect to the machine frame, (d) a vertical tie conveyor connected to the machine frame and arranged adjacent the tie exchanging device, (1) the tie exchanging device and vertical tie conveyor being arranged within the recessed frame portion, (e) an auxiliary carrier frame mounting the tie exchange device, (f) a carriage supporting the tie gripping means for rotation about a vertical axis, (1) the carriage being longitudinally displaceable along a guide track on the auxiliary carrier frame in the operating direction, (g) a drive for rotating the carriage, (h) a guide element extending transversely to the auxiliary carrier frame and telescopingly receiving the tie gripping means, (1) the tie gripping means being displaceable in said transversely extending guide element, and (i) a drive for displacing the tie gripping means in the guide element.

14. The machine of claim 13, further comprising a tie transporting device arranged on the auxiliary carrier frame between the tie exchanging device and the vertical tie conveyor, the tie transporting device comprising an endless tie collecting conveyor bend extending below and parallel to the auxiliary carrier frame in the operating direction, a drive for operating the conveyor band, a vertically adjustable clamping means for gripping ties collected on the endless conveyor band, and a drive for vertically adjusting the clamping means, the clamping means being transversely displaceably mounted on the carriage.

15. The machine of claim 14, wherein one end of the auxiliary carrier frame is linked to the recessed frame portion, and the vertical tie conveyor comprises two vertically adjustable fork lift elements arranged to support opposite ends of ties collected on the endless conveyor band, the fork lift elements extending through an opening in the one end of the auxiliary carrier frame and the opening having a width corresponding to at least one tie length, a drive for vertically adjusting the fork lift elements between a lower and an upper position, and further comprising two L-shaped tie retaining ledges mounted on the machine frame for pivoting about an axis extending in the operating direction, the tie retaining ledges extending in said direction at the level of the upper end position of the fork lift elements and being spaced a distance substantially corresponding to one tie length, and a drive means for pivoting the ledges between a tie retaining and tie releasing position.

16. The machine of claim 15, further comprising a respective rod-shaped intermediate member bridging over each one of the fork lift elements and quick-release fastening means for attaching the intermediate members to the ends of the fork lift elements for converting the vertical tie conveyor from conveying old ties to conveying new ties.

17. The machine of claim 14, further comprising vertically adjustable support rollers arranged at least at one aide of the endless conveyor band, the support rollers being rotatable about axes extending in the operating direction, support arms linking the support rollers to an underside of the carriage, and drive means for pivoting the support arms for vertically adjusting the support rollers.

18. A machine for exchanging a group of at least one old tie for a group of at least one new tie in a railroad track consisting of two rails fastened to ties, which comprises (a) a self-propelled standard railroad vehicle comprising
  (1) a bridge-like machine frame,
  (2) undercarriages supporting the machine frame for mobility on the railroad track, the machine frame defining an upwardly recessed portion between the undercarriages,
  (3) a drive for advancing the vehicle in an operating direction, and
  (4) an operator's cab, (b) a tie exchanging device connected to the machine frame and arranged within sight of the operator's cab, the tie exchanging device being operable for withdrawing the old ties and inserting the new ties and comprising
  (1) a longitudinally adjustable tie gripping means including a tie clamp for gripping an end of the ties laterally projecting from the track,
  (2) a drive for longitudinally adjusting the tie gripping means for respectively moving the old ties laterally out of, and inserting the new ties laterally into, the track, and
  (3) respective drives for vertically adjusting and for operating the tie clamp between tie engaging and tie releasing positions, (c) a drive connected to the tie exchanging device for longitudinally displacing the device in the operating direction with respect to the machine frame, (d) a vertical tie conveyor connected to the machine frame and arranged adjacent the tie exchanging device,
  (1) the tie exchanging device and vertical tie conveyor being arranged within the recessed frame portion, (e) an auxiliary carrier frame mounting the tie exchange device,
  (1) one end of the auxiliary carrier frame being linked to the recessed frame portion and an opposite end thereof being supported on the railroad track by an undercarriage, (f) a hold-down clamping means adjacent the undercarriage,
  (1) the clamping means being arranged for clampingly engaging at least one rail head of the railroad track, and (g) a drive for operating the clamping means.

19. The machine of claim 18, wherein the rail head clamping means is connected to the tie exchanging device.

20. A machine for exchanging a group of at least one old tie for a group of at least one new tie in a railroad track consisting of two rails fastened to ties, which comprises (a) a self-propelled standard railroad vehicle comprising
  (1) a substantially horizontally extending machine frame defining respective openings at the ends thereof,
  (2) undercarriages supporting the machine frame for mobility on the railroad track,
  (3) a drive for advancing the vehicle in an operating direction, and
  (4) an operator's cab, (b) a tie exchange device longitudinally displaceably mounted on the horizontally extending machine frame and arranged within sight of the operator's cab, the tie exchanging device being operable for withdrawing the old ties and inserting the new ties and comprising
  (1) a longitudinally adjustable tie gripping means including a tie clamp for gripping an end of the ties laterally projecting from the track
  (2) a drive for longitudinally adjusting the tie gripping means for respectively moving the old ties laterally out of, and inserting the new ties laterally into, the track, and
  (3) respective drives for vertically adjusting and for operating the tie clamp between tie engaging and tie releasing positions, (c) a drive connected to the tie exchanging device for longitudinally displacing the device in the operating direction with respect to the machine frame, (d) a reversibly driven endless tie transporting conveyor band for selectively removing old ties from the tie exchange device to a selected one of the openings and feeding new ties from a selected one of the openings to the tie exchange device while the ties are positioned transversely to the track, (1) the openings in the machine frame having a width corresponding to at least one tie length, and (e) a tie conveyor device connected to the machine frame for respectively lifting and lowering the transversely positioned ties through the selected opening from and to the conveyor band.

21. A machine for exchanging a group of at least one old tie for a group of at least one new tie in a railroad track consisting of two rails fastened too ties, which comprises (a) a self-propelled standard railroad vehicle comprising (1) a bridge-like machine frame, (2) undercarriages supporting the machine frame for mobility on the railroad track, the machine frame defining an upwardly recessed portion between the undercarriages, (3) a drive for advancing the vehicle in an operating direction, and (4) an operator's cab, (b) a tie exchanging device connected to the machine frame and arranged within sight of the operator's cab, the tie exchanging device being operable for withdrawing the old ties and inserting the new ties and comprising (1) a longitudinally adjustable tie gripping means including a tie clamp for gripping an end of the ties laterally projecting from the track, (2) a drive for longitudinally adjusting the tie gripping means for respectively moving the old ties laterally out of, and inserting the new ties laterally into, the track, and (3) respective drives for vertically adjusting and for operating the tie clamp between tie engaging and tie releasing positions, (c) a drive connected to the tie exchanging device for longitudinally displacing the device in the operating direction with respect to the machine frame, (d) a vertical tie conveyor connected to the machine frame and arranged adjacent the tie exchanging device, (1) the tie exchanging device and vertical tie conveyor being arranged within the recessed frame portion, and (e) a tie transporting device comprising an endless conveyor band arranged between the tie exchanging device and the vertical tie conveyor.

* * * * *